US010490948B2

(12) United States Patent
Wu et al.

(10) Patent No.: US 10,490,948 B2
(45) Date of Patent: Nov. 26, 2019

(54) ELECTRICAL CONNECTOR WITH INTEGRAL SECUREMENT

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Xiao-Xiang Wu, Kunshan (CN); Wei Zhong, Kunshan (CN); Jian-Kuang Zhu, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/239,499

(22) Filed: Jan. 3, 2019

(65) Prior Publication Data

US 2019/0207348 A1 Jul. 4, 2019

(30) Foreign Application Priority Data

Jan. 3, 2018 (CN) ..... 2018 2 0005751 U

(51) Int. Cl.
*H01R 9/05* (2006.01)
*H01R 13/6585* (2011.01)
(Continued)

(52) U.S. Cl.
CPC ..... *H01R 13/6585* (2013.01); *H01R 13/6582* (2013.01); *H01R 13/6597* (2013.01); *H01R 24/30* (2013.01)

(58) Field of Classification Search
CPC ..... H01R 12/598
(Continued)

(56) References Cited

U.S. PATENT DOCUMENTS 5,241,135 A * 8/1993 Fetzer ..... H01R 9/0512 174/88 R
5,768,771 A * 6/1998 O'Sullivan ..... H01R 4/187 29/828
(Continued)

FOREIGN PATENT DOCUMENTS

CN 106410517 A 2/2017
CN 106856276 A 6/2017

*Primary Examiner* — Neil Abrams
(74) *Attorney, Agent, or Firm* — Wei Te Chung; Ming Chieh Chang

(57) ABSTRACT

The connector includes an insulative housing, two rows of contacts retained in the housing, and a metallic shell enclosing the housing. The contact includes a contacting section extending into the mating cavity, and a connecting section exposed outside of the housing. An insulative block/spacer is attached to a back side of the housing integrally with a metallic shielding/grounding blade therein. The shielding/grounding blade includes a pair of securing legs at two ends in the transverse direction. A pair of grounding bars are soldered to the outer conductors of the two rows of wires, respectively. Each of the grounding bars includes a pair of securing legs at two ends in the transverse direction. Both the securing legs of the shielding/grounding blade and those of the grounding bars are secured to interior surfaces of the two side walls of the outer shell.

20 Claims, 9 Drawing Sheets

(51) Int. Cl.
*H01R 24/30* (2011.01)
*H01R 13/6597* (2011.01)
*H01R 13/6582* (2011.01)

(58) Field of Classification Search
USPC ..... 439/497, 579
See application file for complete search history.

(56) References Cited

U.S. PATENT DOCUMENTS 5,964,620 A * 10/1999 Takahashi ..... H01R 9/0518 439/579
6,074,225 A * 6/2000 Wu ..... H01R 13/6582 439/101
6,273,749 B1 * 8/2001 Yang ..... H01R 9/0515 439/497
6,338,652 B1 * 1/2002 Ko ..... H01R 9/0515 439/497
6,489,563 B1 * 12/2002 Zhao ..... H01R 9/0524 174/88 C
6,739,910 B1 * 5/2004 Wu ..... H01R 13/514 439/497
7,192,301 B2 * 3/2007 Kuroda ..... H01R 9/032 439/497
7,354,299 B2 * 4/2008 Yamada ..... H01R 9/0512 439/497
7,601,029 B2 * 10/2009 Horiuchi ..... H01R 4/20 439/497
7,637,779 B2 * 12/2009 Nagata ..... H01R 12/598 439/497
8,109,788 B1 * 2/2012 Harlan ..... H01R 12/598 439/579
9,263,835 B2 * 2/2016 Guo ..... H01R 13/6596
9,276,342 B2 * 3/2016 Masubuchi ..... H01R 12/775
9,385,482 B2 * 7/2016 Li ..... H01R 13/6585
9,444,189 B1 * 9/2016 Sattazahn ..... H01R 13/6461
9,590,360 B2 * 3/2017 Chuang ..... H01R 13/6581
9,647,395 B2 * 5/2017 Hsu ..... H01R 13/405
9,653,849 B2 * 5/2017 Hsu ..... H01R 13/6585
9,799,994 B2 * 10/2017 Chen ..... H01R 12/775
9,853,399 B2 * 12/2017 Kao ..... H01R 13/6585
9,985,358 B2 * 5/2018 Zhu ..... H01R 4/027
10,084,244 B1 * 9/2018 Chang ..... H01R 4/023
10,096,936 B2 * 10/2018 Ju ..... H01R 13/6275
10,103,453 B2 * 10/2018 Pao ..... H01R 4/023
10,153,596 B2 * 12/2018 Lin ..... H01R 12/7005
2019/0165507 A1 * 5/2019 Hou ..... H01R 12/775

* cited by examiner

ELECTRICAL CONNECTOR WITH INTEGRAL SECUREMENT

FIELD OF THE DISCLOSURE

The invention is related to an electrical connection, and particularly to an electrical connector having integral securement among the outer shell, the grounding bar and the shielding/grounding blade not only for the mechanical strength consideration but also for the electrical performance consideration of the whole connector.

DESCRIPTION OF RELATED ARTS

U.S. Pat. No. 9,647,395 discloses the electrical connector having the shielding/grounding blade and the grounding bar each of which is equipped with a pair of horizontally extending securing/soldering pads at two opposite ends. Anyhow, it is relatively difficult to solder/weld those parts together with the mounting pads of the outer shell. It is desired to have an electrical connector equipped with the shielding/grounding blade and the grounding bar having thereof the corresponding securing sections which can be easily and securely fixed to the metallic outer shell in a reliable manner.

SUMMARY OF THE DISCLOSURE

An electrical connector assembly includes an electrical connector and the associated two rows of wires. The connector includes an insulative housing, two rows of contacts retained in the housing, and a metallic shell enclosing the housing. The housing forms a mating cavity. The contact includes a contacting section extending into the mating cavity, and a connecting section exposed outside of the housing. The wire includes an inner conductor soldered to the connecting section of the corresponding contact, and an outer conductor or grounding layer. An insulative block/spacer is attached to a back side of the housing integrally with a metallic shielding/grounding blade therein. The shielding/grounding blade includes a pair of securing legs at two ends in the transverse direction. A pair of grounding bars are soldered to the outer conductors of the two rows of wires, respectively. Each of the grounding bars includes a pair of securing legs at two ends in the transverse direction. Both the securing legs of the shielding/grounding blade and those of the grounding bars are secured to interior surfaces of the two side walls of the outer shell.

DETAILED DESCRIPTION OF THE PREFERRED EMBODIMENT

Figure 1:
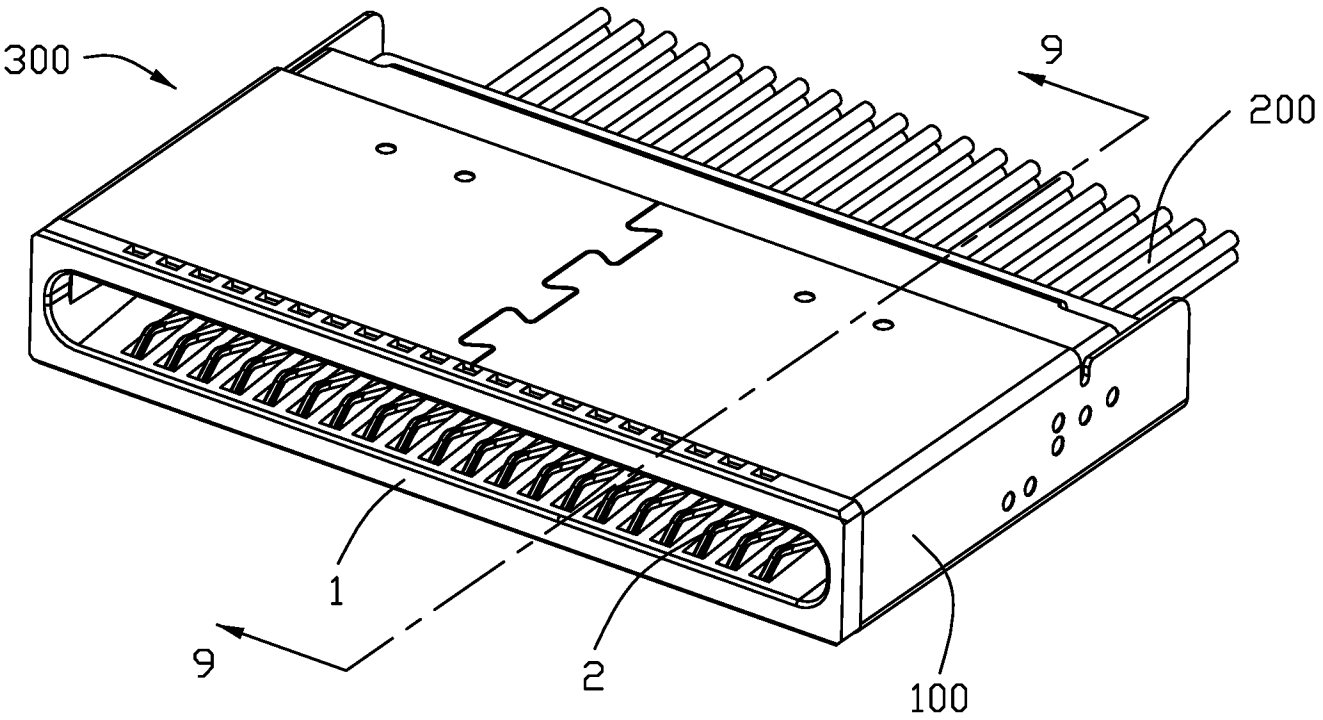
FIG. 1 is a perspective view of an electrical connector assembly according to the invention.
Figure 2:
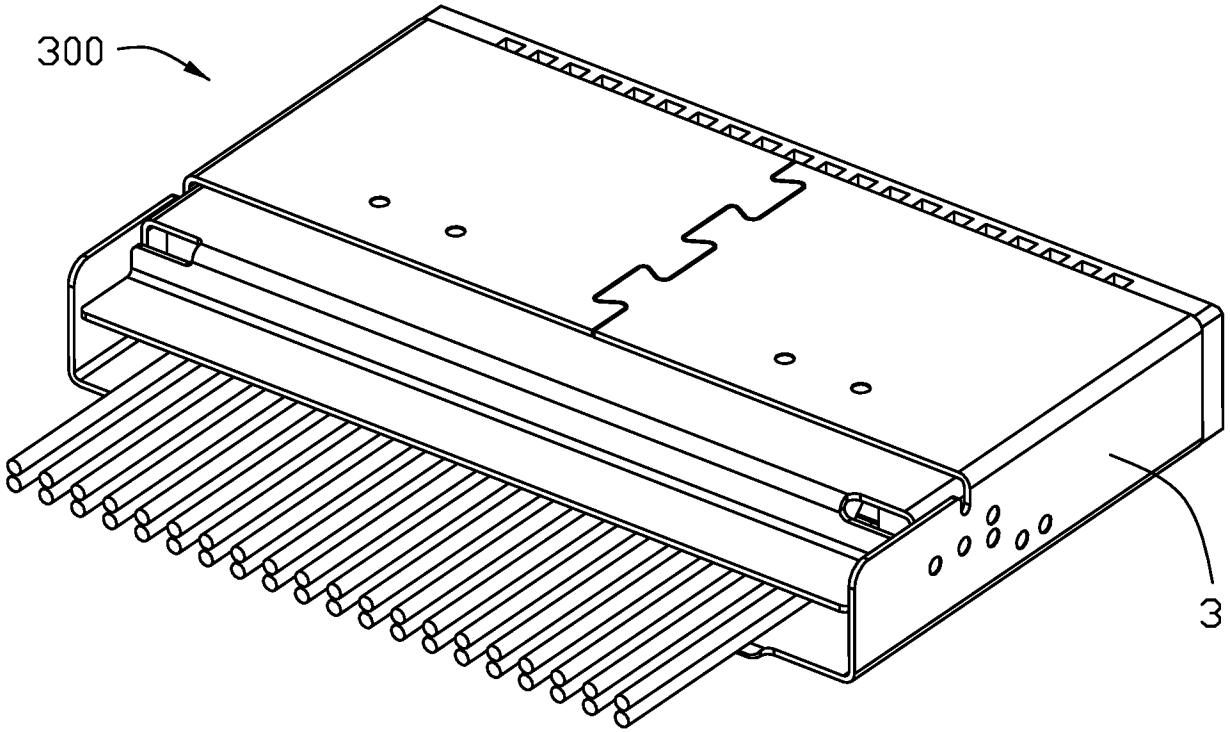
FIG. 2 is another perspective view of the electrical connector assembly of FIG. 1.
Figure 3:
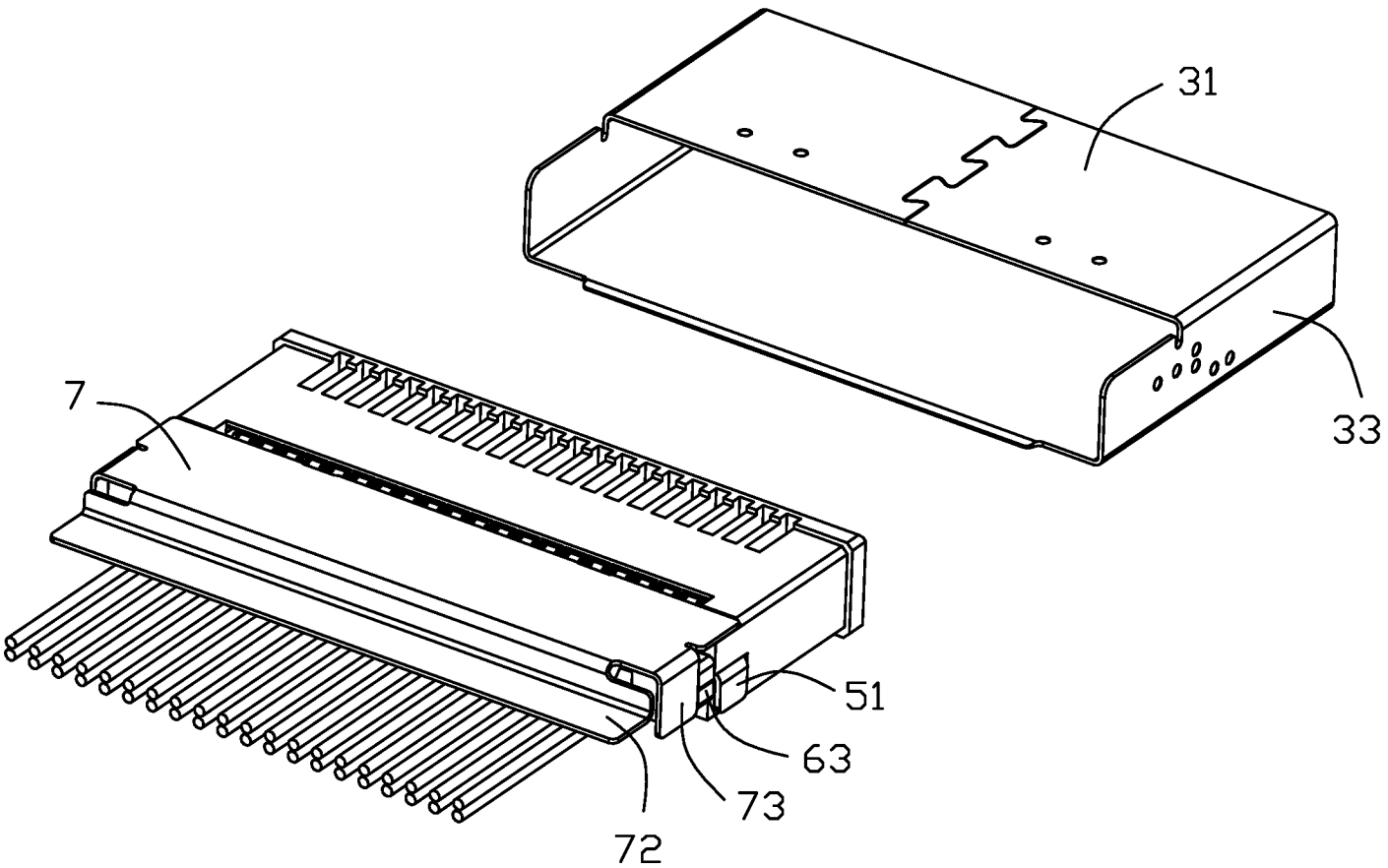
FIG. 3 is an exploded perspective view of the electrical connector assembly of FIG. 2.
Figure 4:
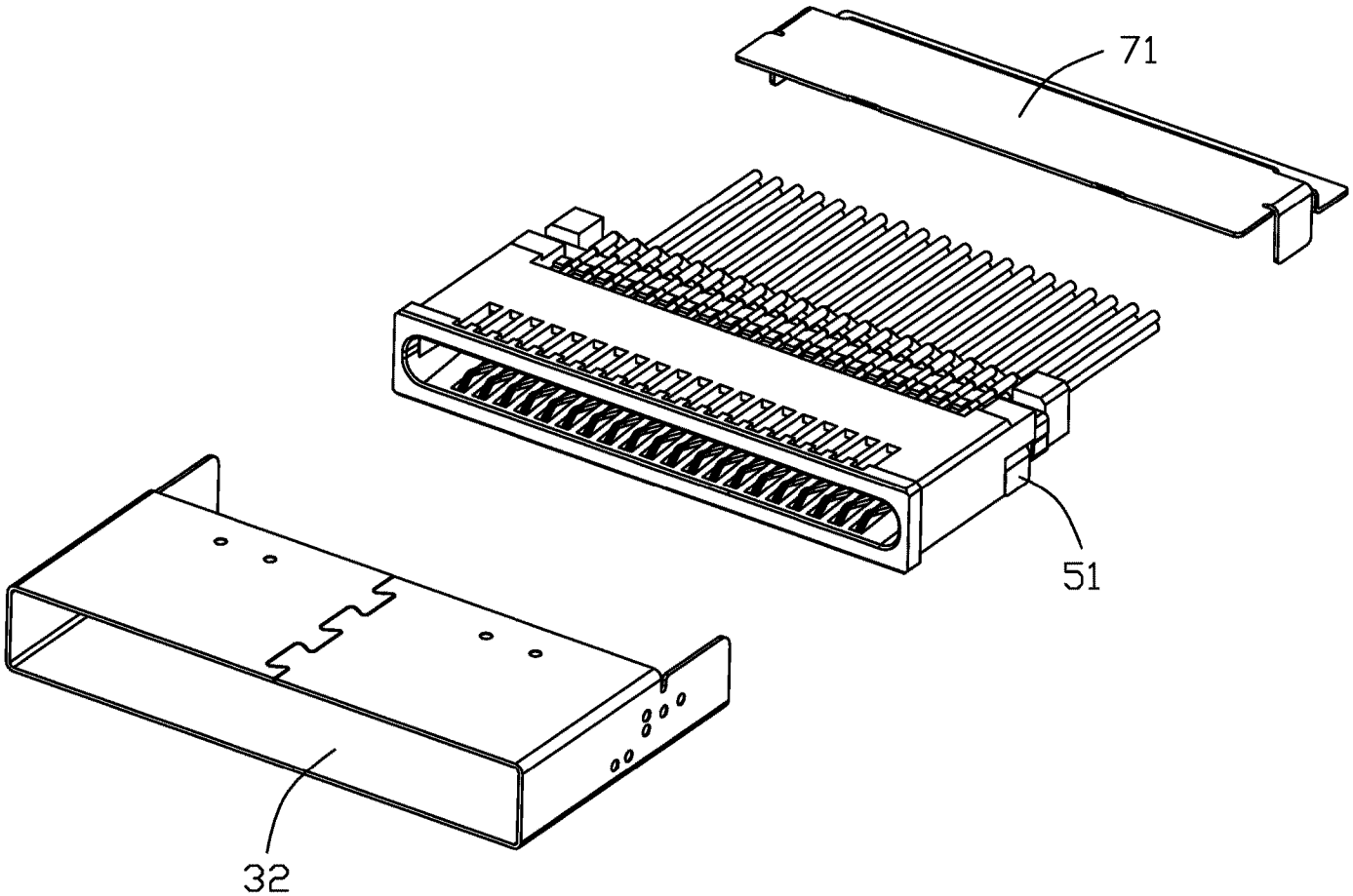
FIG. 4 is a further exploded perspective view of the electrical connector assembly of FIG. 3.
Figure 5:
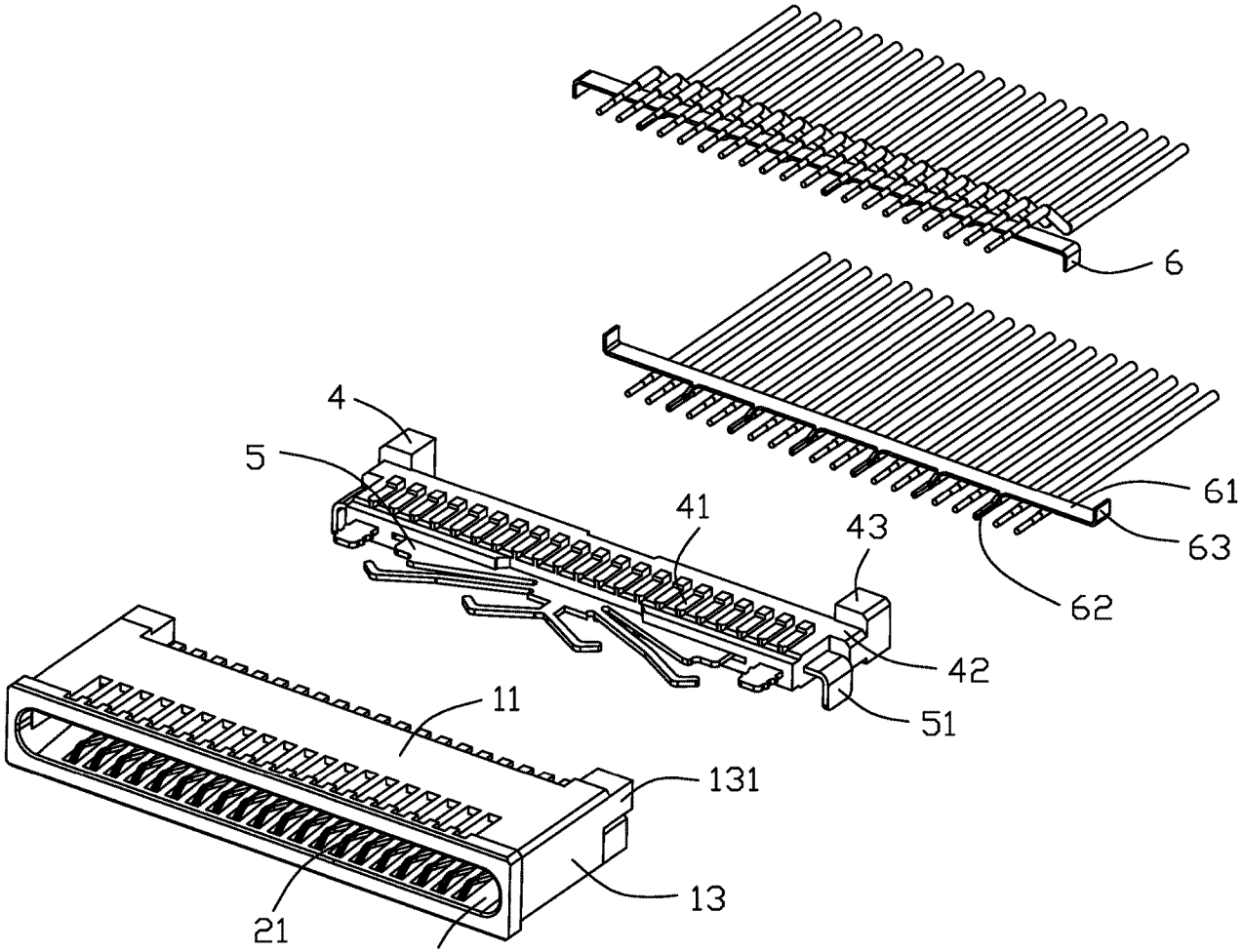
FIG. 5 is a further exploded perspective view of the electrical connector assembly of FIG. 4 without showing the outer shell.
Figure 6:
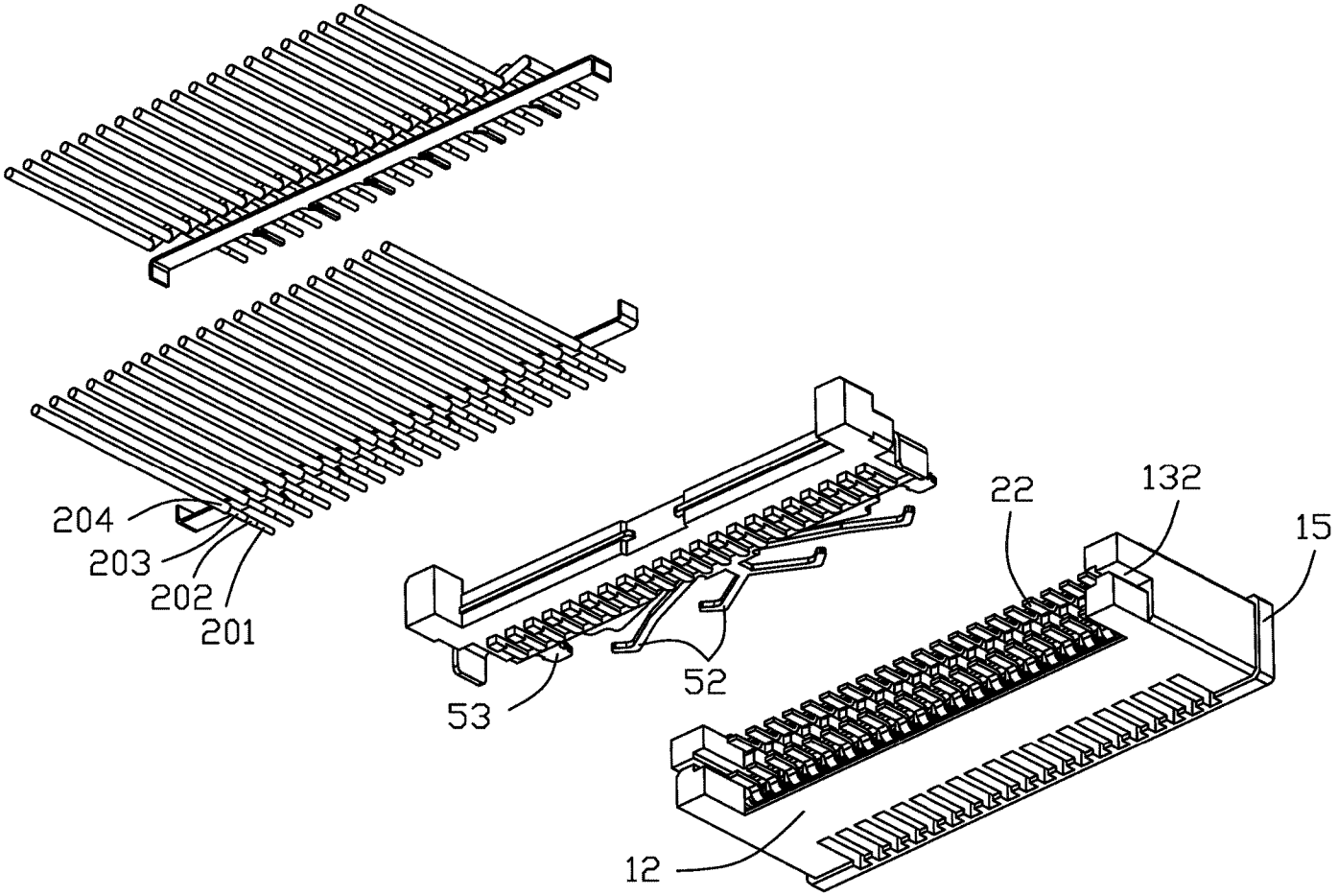
FIG. 6 is another perspective view of the electrical connector assembly of FIG. 5.
Figure 7:
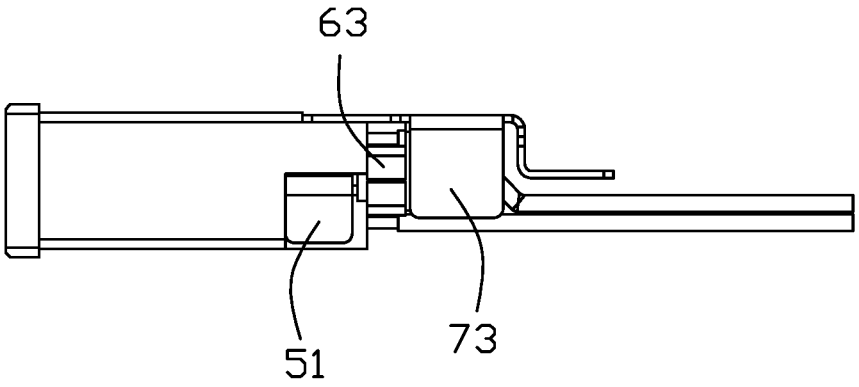
FIG. 7 is a side view of the electrical connector assembly of FIG. 1 without showing the outer shell.
Figure 8:
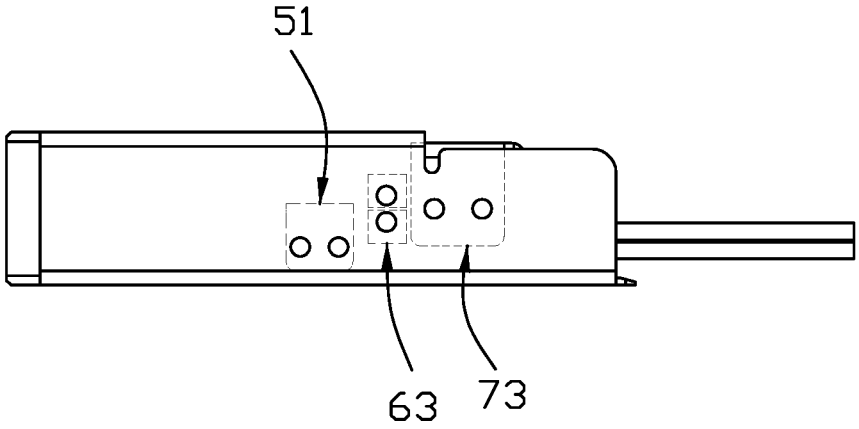
FIG. 8 is a side view of the electrical connector assembly of FIG. 1 with the dashed lines showing the securing legs of the rear cover, the grounding bars and the shielding/grounding blade.
Figure 9:
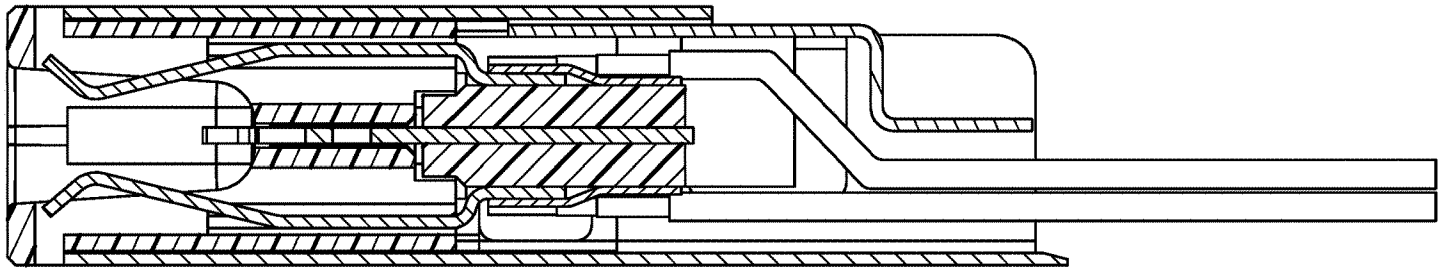
FIG. 9 is a cross-sectional view of the electrical connector assembly of FIG. 1.

An electrical connector assembly 300 includes an electrical connector 100 and two rows of wires 200. The connector 100 includes an insulative housing 1, two rows of contacts 2 retained in the housing 1, and a metallic outer/primary shell 3 enclosing the housing 1.

The housing 1 includes a top wall 11, a bottom wall 12 opposite to the top wall 11 in the vertical direction, a pair of side walls 13 connected at two opposite ends of the top wall 11 and the bottom wall 12 in the transverse direction perpendicular to the vertical direction. A mating cavity 14 is formed by the top wall 11, the bottom wall 12 and the pair of side walls 13. A plurality of passageways (not labeled) are formed in each of the top wall 11 and the bottom wall 12. Each contact 2 has a front contacting section 21 forwardly extending into the mating cavity 14, and a connecting section 22 rearwardly extending outside of the housing 1. The housing 1 forms a flange 15 against which the front edge of the outer shell 3 abuts. A pair of guiding posts 131 extend rearward at two opposite ends of the rear side of the housing 1 with corresponding guiding slits 132 communicating rearwardly with an exterior.

The connector 100 further includes an insulative block/spacer 4 secured to a back side of the housing 1 with a metallic shielding/grounding blade 5 integrally formed therein via an insert-molding process. The insulative block 4 includes a plurality of dividers 41 on opposite upper and bottom surfaces so as to form corresponding slots (not labeled) between every adjacent two dividers 41. The connecting sections 22 of the contacts 2 are disposed in the corresponding slots, respectively. The insulative block 4 further includes a pair of extensions 42 and a pair of supporting platforms 43 at two opposite ends in the transverse direction.

The shielding/grounding blade 5 includes a main plate (not labeled) and a pair of exposed vertically extending securing legs 51 at two opposite ends. A plurality of spring fingers 52 extend from the main plate into the mating cavity 14, and a pair of lances extending from the main plate and retained in the housing 1 to attach the insulative block 4 to a back side of the housing 1. The securing leg 51 extending through the corresponding guiding slit 132, is exposed upon the corresponding side wall 13. The extension 42 is located behind the corresponding guiding post 131.

The wire 200 includes an inner conductor 201, an inner insulator 202, an outer conductor or grounding layer 203 and an outer insulator 204. The inner conductor 201 is connected to the connecting section 22 of the corresponding contact 2. The wires include differential signal wires and the grounding wires alternately arranged with each other along the transverse direction. A pair of grounding bars 6 are soldered to the outer conductors 203 of the two rows of wires 200, respectively. Each grounding bar 6 extends in the transverse direction to be soldered with the outer conductors 203 of all the wires 200 in the same row. Each grounding bar 6 includes a base 61, a plurality of spring tags 62 selectively connecting to the inner conductors 201 of the grounding wire 200, and a pair of securing legs 63 vertically extending at two opposite ends in the transverse direction toward the shielding/grounding blade 5. In this embodiment, the securing leg 63 of the upper grounding bar 6 and that of the lower grounding bar 6 are aligned with each other in the vertical direction. The base 61 of the grounding bar 6 is seated upon the extension 42 behind the guiding post 43 but in front of the supporting platform 43, and the securing leg 63 is exposed upon the side face of the extension 42.

The metallic outer shell 3 has a top plate 31 covering the top wall 11, a bottom plate 32 covering the bottom wall 12, and a pair of side plates 33 covering the side walls 13. In this embodiment, the top plate 31 is shorter than the bottom plate 32 in the front-to-back direction.

A metallic rear cover 7 is located behind the top plate 31. The rear cover 7 includes a main body 71 covering the insulative block 4, a pressing section 72 pressing the wires 200, a pair of vertically extending securing legs 73 at two opposite ends of the main body 71 to abut against the side faces of the corresponding platforms 43. The securing leg 51 of the shielding/grounding blade 5, the securing leg 63 of the grounding bar 6, and the securing leg 73 of the rear cover 7 are sequentially exposed upon the side face of the combination of the housing 1 and the insulative block 4. All three securing legs 51, 63 and 73 are secured to an interior surface of the side plate 33 of the shell 3 via either welding or soldering. The main body 71 of the rear cover 7 is further secured to the top plate 31 of the shell 3 via welding or soldering.

In brief, the securement between the securing legs 51/63/73 and the shell 3 not only enhances the mechanical strength thereof but also the electrical shielding performance While a preferred embodiment according to the present disclosure has been shown and described, equivalent modifications and changes known to persons skilled in the art according to the spirit of the present disclosure are considered within the scope of the present disclosure as described in the appended claims.

What is claimed is:

1. An electrical connector assembly comprising:

an insulative housing defining a mating cavity and two rows of passageways spaced from each other in a vertical direction, each row extending in a transverse direction perpendicular to the vertical direction, each of said passageways extending in a front-to-back direction perpendicular to both the transverse direction and the vertical direction;

a metallic outer shell enclosing the housing and including opposite top plate and bottom plate, and opposite two side plates;

two rows of contacts disposed in the corresponding passageways, respectively, each of said contacts including, along the front-to-back direction, a front contacting section extending into the mating cavity, and a rear connecting section;

an insulative block attached to a back side of the housing;

two rows of wires located behind the insulative block, the wires including differential signal wires and grounding wires alternately arranged with each other along the transverse direction, each of wires including sequentially an inner conductor, an inner insulator, an outer conductor and an outer insulator, the inner conductors of the wires mechanically and electrically connected to the connecting sections of the corresponding contacts, respectively;

a pair of grounding bars each including a base extending along a transverse direction and soldered to the outer conductors of one row of wires, a pair of vertically extending securing legs at two opposite ends in the transverse direction, and a plurality of spring tags mechanically and electrically connected to the inner conductors of the grounding wires; wherein the pair of securing legs are electrically and mechanically fixedly connected to interior surfaces of the pair of side plates, respectively.

2. The electrical connector assembly as claimed in claim 1, wherein each grounding bar is seated upon the insulative block.

3. The electrical connector assembly as claimed in claim 2, wherein the connecting sections of the contacts are seated upon the insulative block.

4. The electrical connector assembly as claimed in claim 3, wherein the wires cooperate with the insulative block to sandwich the corresponding grounding bar therebetween in the vertical direction.

5. The electrical connector assembly as claimed in claim 4, wherein the spring tag of the grounding bar is sandwiched between the inner conductor of the corresponding grounding wire and the connecting section of the corresponding contact in the vertical direction.

6. The electrical connector assembly as claimed in claim 1, further including a metallic shielding/grounding blade having a main plate integrally formed within the insulative block, wherein a plurality of spring fingers extend from the main plate into the mating cavity between two rows of the contacts in the vertical direction, and a pair of vertically extending securing legs at two opposite ends of the main plate in the transverse direction, and each of said securing leg of the shielding/grounding blade is located intimately in front of the corresponding securing leg of the grounding bar in the front-to-back direction.

7. The electrical connector assembly as claimed in claim 6, wherein said securing leg of the shielding/grounding blade is electrically and mechanically fixedly connected to the interior surface of the corresponding side plate.

8. The electrical connector assembly as claimed in claim 7, further including a metallic rear cover attached behind the top plate, wherein said rear cover includes a pressing section pressing the wires in the vertical direction, and a pair of vertically extending securing legs supported by the insulative block and located intimately behind the securing legs of the grounding bar in the front-to-back direction.

9. The electrical connector assembly as claimed in claim 8, wherein the securing leg of the rear cover is electrically and mechanically fixedly connected to the interior surface of the corresponding side plate.

10. The electrical connector assembly as claimed in claim 6, wherein the securing leg of the shielding/grounding blade extends through a corresponding guiding slot in the housing in the transverse direction.

11. An electrical connector assembly comprising:

an insulative housing defining a mating cavity and two rows of passageways spaced from each other in a vertical direction, each row extending in a transverse direction perpendicular to the vertical direction, each of said passageways extending in a front-to-back direction perpendicular to both the transverse direction and the vertical direction;

a metallic outer shell enclosing the housing and including opposite top plate and bottom plate, and opposite two side plates;

two rows of contacts disposed in the corresponding passageways, respectively, each of said contacts including, along the front-to-back direction, a front contacting section extending into the mating cavity, and a rear connecting section;

an insulative block attached to a back side of the housing;

two rows of wires located behind the insulative block, the wires including differential signal wires and grounding wires alternately arranged with each other along the transverse direction, each of wires including sequentially an inner conductor, an inner insulator, an outer conductor and an outer insulator, the inner conductors of the wires mechanically and electrically connected to the connecting sections of the corresponding contacts, respectively; and a metallic shielding/grounding blade having a main plate integrally formed within the insulative block, wherein a plurality of spring fingers extend from the main plate into the mating cavity between two rows of the contacts in the vertical direction, and a pair of vertically extending securing legs at two opposite ends of the main plate in the transverse direction; wherein each of the securing leg is electrically and mechanically fixedly connected to an interior surface of the corresponding side plate.

12. The electrical connector assembly as claimed in claim 11, wherein the securing leg of the shielding/grounding blade extends through a corresponding guiding slot in the housing in the transverse direction.

13. The electrical connector assembly as claimed in claim 12, further including a metallic rear cover attached behind the top plate, wherein said rear cover includes a pressing section pressing the wires in the vertical direction, and a pair of vertically extending securing legs supported by the insulative block and located behind the securing legs of the grounding bar in the front-to-back direction.

14. The electrical connector assembly as claimed in claim 13, wherein the securing leg of the rear cover is electrically and mechanically fixedly connected to the interior surface of the corresponding side plate.

15. The electrical connector assembly as claimed in claim 11, further including a pair of grounding bars each including a base extending along a transverse direction and soldered to the outer conductors of one row of wires, and a plurality of spring tags mechanically and electrically connected to the inner conductors of the grounding wires.

16. The electrical connector assembly as claimed in claim 15, wherein each ground bar is seated upon the insulative block and located between the wires and the insulative block in the vertical direction.

17. The electrical connector assembly as claimed in claim 16, wherein each grounding bar is located behind the shielding/grounding blade in the front-to-back direction electrically and mechanically fixedly connected to the outer shell.

18. An electrical connector assembly comprising:

an insulative housing defining a mating cavity and two rows of passageways spaced from each other in a vertical direction, each row extending in a transverse direction perpendicular to the vertical direction, each of said passageways extending in a front-to-back direction perpendicular to both the transverse direction and the vertical direction;

a metallic outer shell enclosing the housing and including opposite top plate and bottom plate, and opposite two side plates;

two rows of contacts disposed in the corresponding passageways, respectively, each of said contacts including, along the front-to-back direction, a front contacting section extending into the mating cavity, and a rear connecting section;

an insulative block attached to a back side of the housing;

two rows of wires located behind the insulative block, the wires including differential signal wires and grounding wires alternately arranged with each other along the transverse direction, each of wires including sequentially an inner conductor, an inner insulator, an outer conductor and an outer insulator, the inner conductors of the wires mechanically and electrically connected to the connecting sections of the corresponding contacts, respectively;

a pair of grounding bars each including a base extending along a transverse direction and soldered to the outer conductors of one row of wires, a pair of securing legs and a plurality of spring tags mechanically and electrically connected to the inner conductors of the grounding wires;

a metallic shielding/grounding blade having a main plate integrally formed within the insulative block, wherein a plurality of spring fingers extend from the main plate into the mating cavity between two rows of the contacts in the vertical direction; and a metallic rear cover attached behind the top plate, wherein said rear cover includes a pressing section pressing the wires in the vertical direction, and a pair of vertically extending securing legs supported by the insulative block and located behind the securing legs of the grounding bar in the front-to-back direction; wherein each of said securing legs of said rear cover is electrically and mechanically fixedly connected to an interior surface of the corresponding side plate.

19. The electrical connector assembly as claimed in claim 18, wherein each of said grounding bar further includes a pair of vertically extending securing legs electrically and mechanically fixedly connected to the interior surface of the corresponding side plate.

20. The electrical connector assembly as claimed in claim 18, wherein the shielding/grounding blade further includes a pair of vertically extending securing legs electrically and mechanically fixedly connected to the interior surface of the corresponding side plate.

* * * * *